United States Patent [19]

Ochs

[11] Patent Number: 5,009,324

[45] Date of Patent: Apr. 23, 1991

[54] CLOSURE HAVING THERMALLY RESPONSIVE WATER WASHING SLOTS

[75] Inventor: Charles S. Ochs, Lancaster, Ohio

[73] Assignee: Anchor Hocking Corporation, Lancaster, Ohio

[21] Appl. No.: 535,400

[22] Filed: Jun. 8, 1990

Related U.S. Application Data

[63] Continuation-in-part of Ser. No. 402,211, Sep. 1, 1989.

[51] Int. Cl.[5] ..... B65D 51/16

[52] U.S. Cl. ..... 215/276; 215/274

[58] Field of Search ..... 215/276, 273, 274, 279, 215/309, 341, 343, 350, 351, DIG. 1

[56] References Cited

U.S. PATENT DOCUMENTS

| | | | |
|---|---|---|---|
| 2,080,686 | 5/1937 | Bennett | 215/350 X |
| 2,270,729 | 1/1942 | Geddes . | |
| 2,449,014 | 9/1948 | Shaffer . | |
| 4,093,094 | 6/1978 | Smalley et al. | 215/276 |
| 4,121,729 | 10/1978 | Husum | 215/276 |
| 4,408,694 | 10/1983 | Mueller | 215/276 |
| 4,473,163 | 9/1984 | Geiger | 215/276 X |
| 4,694,969 | 9/1987 | Granat | 215/274 X |
| 4,705,183 | 11/1987 | Moloney | 215/276 |
| 4,721,219 | 1/1988 | Dullabaun et al. | 215/274 |
| 4,807,770 | 2/1989 | Barriac . | |
| 4,809,858 | 3/1989 | Ochs | 215/276 |
| 4,813,561 | 3/1989 | Ochs | 215/276 X |
| 4,880,127 | 11/1989 | Doi . | |

*Primary Examiner*—Stephen Marcus
*Assistant Examiner*—Vanessa M. Roberts
*Attorney, Agent, or Firm*—Wood, Herron & Evans

[57] ABSTRACT

A closure is provided with slots through which wash water can flow to wash food particles from the interthread space between the closure and a container, after the closure has been secured onto the container. At room temperature the washing slots are essentially closed to the ingress of dirt particles, but they open when the closure is heated so that water can flow through them and into the interthread space.

10 Claims, 2 Drawing Sheets

CLOSURE HAVING THERMALLY RESPONSIVE WATER WASHING SLOTS

RELATED APPLICATIONS

This application is a continuation-in-part of my copending applications Ser. No. 402,211, filed Sept. 1, 1989, titled "Container Closure With Channels For Water Washing," and Ser. No. 535,114, filed June 5, 1990, titled "Package With Pressure Venting Closure Accepting Different Types of Insert Disks for Different Food Products."

FIELD OF THE INVENTION

This invention relates to closures for food containers, and more particularly to a closure having water flow passages for washing the interthread space after the closure has been secured onto the container.

BACKGROUND OF THE INVENTION

In the food packing industry it sometimes happens that a small amount of the food being packed (for example, baby food) will splash onto the finish or threads of the container while the container is being filled. The splashed food will of course spoil if it remains, but normally water washing or spray cooling removes it. However, sometimes food remains lodged in the area between the closure and the container (the so-called "interthread space"), and could present a potential problem. Thus there has been a need for a closure which enables the space between the closure and the container to be washed or flushed clean, after the closure has been applied to the container.

My earlier application Serial No. 402,211, previously referred to, discloses a container closure for that purpose, having internal channels for water washing. In a composite closure embodiment, a lid or insert disk is seated within an annular shell, beneath an overhanging top lip of the shell. Water wash channels are provided on the underside of the top lip of the shell, above the disk, and extend from the inner edge of the lip outwardly over the edge of the insert disk. One or more stops or bearing areas on the underside of the top lip prevent the channels from being blocked and closed by the disk if the closure is overtightened. The wash channels extend past the edge of the disk and communicate with the interthread space, which in turn communicates with an outlet below. Water onto the insert disk of the closure flows through the wash channels outwardly over the edge of the disk and downwardly into the interthread region, to wash out food particles.

However, tiny dust or dirt particles can in theory also pass through the wash channels and into the interthread region, after washing has been completed. The channels at their smallest cross-sections can be very small in size, but smaller particles could conceivably still pass through. If such small dust or dirt particles settled onto the top of the insert disk prior to opening, they could be swept through the wash passages by the in-rush of air into the partial vacuum beneath the disk when the disk is first lifted. Thus the water wash channels, while permitting splashed food to be washed out, nevertheless can permit dirt to be carried onto the surface of the food when the container is later opened.

BRIEF DESCRIPTION OF THE INVENTION

In accordance with this invention, water wash channels are provided which are normally closed so as to block foreign particles which might otherwise pass through, but the passages are opened by thermal expansion when the closure is heated substantially hotter than normal ambient temperature, as by steam or hot wash water. Hot water washing is normally carried out at temperatures well above ordinary room temperature, for example above about 180° F., and the passages (or narrow restrictions in them) expand when heated to hot water wash temperatures, and then permit an effective flow of wash water. However, at lower temperatures after washing, the restrictions again contract thermally to a smaller size at which they block ingress of foreign particles. Thus the passages are normally closed so as not to permit the ingress of dirt, and open only when needed for water washing purposes, by the heat attendant the washing.

In a preferred embodiment of the invention, thermally expansible restrictions are provided in the water passages, by and between the periphery of the insert disk and an encircling annular shoulder or lip on the underside of the top lip of the closure. The shell is made of a material (typically a thermoplastic) which has a substantially greater rate of thermal expansion than the disk, which is typically metal or a composite having a metal base. Normally, the shoulder or lip of the shell circumferentially engages the periphery of a downturned flange or skirt on the disk at room temperature; but if the closure is heated by hot water or steam the shell (including the shoulder or lip) expands radially more than the disk, thus opening the previous restriction between the shell and the disk so that water can flow past it for effective washing.

In practice, the passages need not be tightly sealed at room temperature; for many purposes it is sufficient that the restricted opening be less than about 0.005" wide, which is currently taken to be the largest size of foreign (dirt) particles that should excluded. Thus, as the container is heated, the restrictions in the wash channels, which may be very small or entirely closed, expand to a size large enough to pass a flow of wash water effective to dislodge food particles.

It is an advantage of the invention that the thermally responsive flow blocking means can be provided with only a small structural change in the closure disclosed in my previously identified application Ser. No. 402,211. The present structure adds little additional material or complexity, yet by it the passages are automatically opened for washing but automatically closed at other times to prevent the admission of dirt.

DESCRIPTION OF THE DRAWINGS

The invention can best be further described by reference to the accompany drawings, in which.

DETAILED DESCRIPTION

Figure 1:
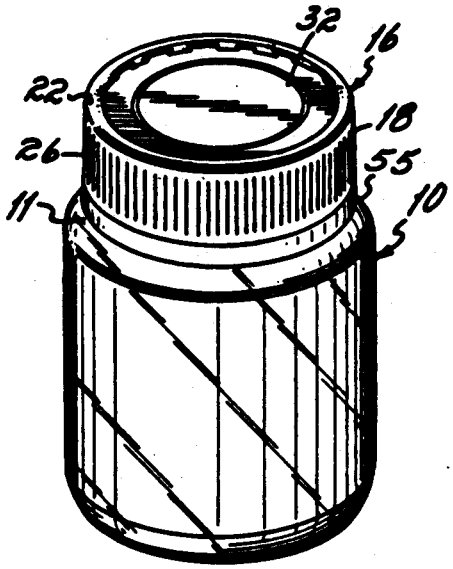
FIG. 1 is a perspective view of a closure on a container.

The invention can be used in closures which have a tamper indicating band as well as in those which do not. For purposes of explanation, the drawings show a preferred embodiment of the invention in a closure having a tamper indicating band.

Referring to the drawings in more detail, a container designated generally by 10 has a neck 11 and a finish 12, and is sealed by a removable closure 16. The container may be of glass or of molded plastic; closure 16 is a composite of a plastic shell and a separate insert disk. The container 10 shown for purposes of illustration has continuous helical threads 13 which cooperate with internal threads 28 of closure 16, but the invention is also useful with containers having interrupted screw lugs. As used herein the term "thread" is meant to include both a continuous thread and discontinuous lugs.

Figure 2:
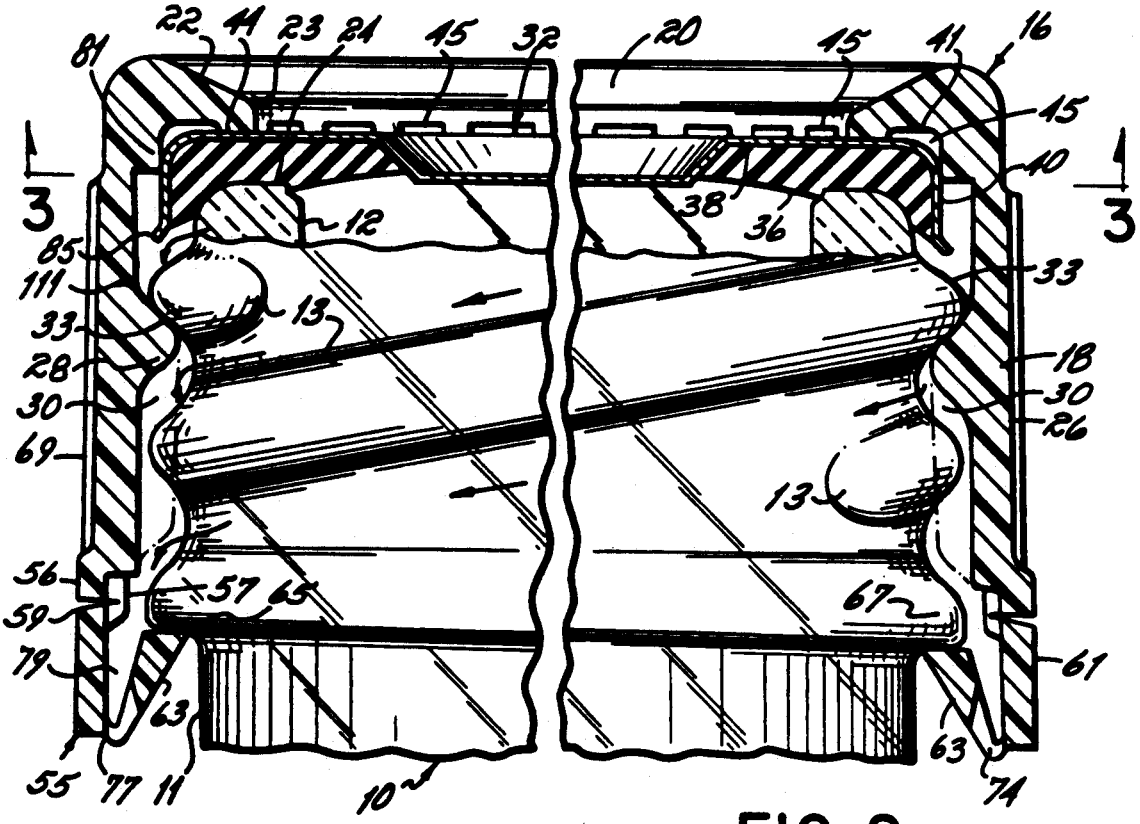
FIG. 2 is an enlarged axial section of a closure in accordance with a preferred embodiment of the invention, as applied to a closure.

Closure 16 includes an annular shell 18 which has a top opening 20. Closure shell 18 may be an integral molding of thermoplastic material such as polypropylene, which has a thermal expansion coefficient of about 4.4–5.7 in./in./.F$\times 10^{-5}$. Shell 18 has an annular top lip 22 which projects inwardly, above the top edge 24 of container 10, and defines a peripheral edge 23 of top opening 20. The side wall of the closure shell 18 includes a generally cylindrical skirt portion 26. As can be seen in FIG. 2, when closure 16 is secured on container 10 the threads 28 of the closure bear on the underside of the respective threads 13 of the container; because the closure threads do not completely fill the spaces between the container threads an interthread space or channel 30 is presented between and around the threads of the closure and those of the container. In the embodiment shown, this interthread space is in the form of an internal spiral passage between skirt 26 and container 10.

Top opening 20 of the container is closed and sealed by a lid or insert disk 32 which is retained within shell 18 by the top lip 22 thereof, and by the upper ends 33 of threads 28 below the disk. Disk 32 may be of steel, which has a coefficient of thermal expansion of about 6.3 in./in./° F.$\times 10^{-6}$, significantly smaller than that of plastic shell 18. The disk could also be made of other materials with a low coefficient of expansion as compared to the plastic shell. Disk 32 has a downwardly opening groove or recess 38 which carries a gasket 36 on its lower surface (FIG. 2). Preferably but not necessarily disk gasket 36 may be a flowed-in plastisol gasket. Around its periphery, disk 32 has a downwardly extending rim or flange 40. In the preferred embodiment the disk is inserted from the bottom of the shell ("bottom loaded") against the underside of lip 22.

When the closure has been applied to the container, gasket 36 engages the top edge of the container. After retorting or after the container has been chilled, the air pressure beneath the disk in the container is lower than the external air pressure which acts downwardly on the disk 24, and the pressure differential holds the gasket 36 tightly against the container to seal it. The top lip 22 does not usually provide the sealing force.

As previously indicated, it sometimes happens that a bit of food product may be splashed on the side wall or the threads of the container, where it can spoil. It is therefore desirable to be able to wash the interthread space 30 after the closure has been applied. The closure of this invention has one or more internal passages through which a water wash, directed onto the top of the disk, can flow from the top of the disk into the interthread space, then downwardly through the spiral and drain at the bottom of the closure. This invention also provides a restriction which effectively closes or blocks those flow passages to dirt particles at room temperature (e.g., below about 80° F.), but opens to permit the flow of wash water at the higher temperature of washing.

More specifically, one or more water passages 45 in the form of channels or recesses are provided on the lower face or underside 41 of lip 22. A low, slotted peripheral rim or flap 44 depends along the inner edge 23 of top lip 22. The passage 45 is recessed in the underface of lip 22, outward of rim 44. Notches or slots 46 in rim 44 permit water to flow past the rim into passage 45. The passage extends radially outwardly beyond the downturned disk rim 40 and downwardly on the inside face of shell 18, into the interthread channel 30. Water directed onto disk 32 can flow into passages 45, radially and to some extent peripherally around the disk (see FIG. 3), and into the interthread region 30. In that region, the wash can flow along and between the threads as indicated by the arrow in FIG. 2 to wash virtually the entire area between the threads except where the threads of the closure actually bear on the container threads.

Top lip 22 is supported by the shell 18 only around the outside, and therefore the lip can deform upwardly when the shell is tightened on the disk. The unrecessed areas 49 of the rim, between the passage 45 is recessed, act as stops, bosses, or spacers to prevent deformation on overtightening from choking or closing the water passages.

Closure 16 includes a tamper indicating band 55 around the lower edge 56 of its shell. The band is frangibly connected to the shell, as by severable or rupturable bridges, one of which is shown at 57, there being a perforation or knife cut or score 59 between band 55 and lower edge 56 of shell 18. Band 55 includes an external band or ring 61 with an upturned retaining means or hoop 63 having an inner edge 65 which engages beneath a locking bead 67 around the container. When the closure is unscrewed by applying torque to grips 69, the entire closure initially moves upwardly. When the upper end 65 of hoop 63 bears upwardly against locking bead 67, a force is exerted which tends to separate band 55 axially from the rest of the closure and causes the bridges 57 to rupture. Separation of band 55 provides a distinct visual indication that the closure has been opened. Water outlet windows 74 are provided along the hinge line 77 between hoop 63 and band 55. Wash water from interthread chamber 30 will flow into the V-shaped space 79 between upturned hoop 63 and tamper indicating band 55, and will drain from the windows 74. While the invention is not limited to use with a tamper evidencing band, a preferred form of tamper indicating band is shown in the copending application of Thomas H. Hayes, titled "Tamper Indicating Closure Having Retaining Hoop With Relief Windows," Ser. No. 401,966, filed Sept. 1, 1989.

Closures for vacuum sealed containers should desirably prevent smaller particles as well as insects and large particles on the lid from being sucked into the container by the inrush of air when the vacuum beneath disk 32 is broken as the lid is lifted. In theory, even tiny dirt particles on the disk might be blown over the edge 40 of the disk, inwardly past the gasket 36 and into the container upon opening. In the closure as thus far described, the wash passages 45 could in theory provide such a pathway for small particles.

In accordance with the invention, the wash channels include passage blocking means which normally (i.e., at normal or room temperature) virtually close them to ingress of dirt. In the embodiment shown in FIGS. 2 and 3, the passage blocking means is provided by a continuous internal circular shoulder or rib 81 which extends annularly around the inside of the shell, just outwardly of the downturned flange 40 of disk 32. This rib 81 has an inside diameter which, at ordinary room temperatures, has an inside diameter approximately equal to the outside diameter of disk flange 40 so that the rib effectively closes the passage along that circumferential line. Thus the restriction effectively blocks dirt from getting into the interthread space while the package is being stored. Because the restriction is opened by thermal expansion from the heat accompanying water washing, the shell should be of a material having a coefficient of expansion greater than that of the disk. In practice the actual size of the slot that is opened will depend on materials, use temperatures and wash temperatures, and the invention can thus be adapted for specific conditions.

It should be noted that, while the coefficient of expansion of the shell material is generally the same in both the axial and the radial directions, the actual amount of thermal expansion upon heating is much greater in the radial direction than in the axial direction, because the shoulder diameter is several times greater than the vertical dimension involved. A sufficient gap can open by reason of the large radial expansion, even though expansion in the axial direction is substantially less. Thus as a practical matter it is preferred that the rib engage the disk radially, rather than axially.

Figure 4:
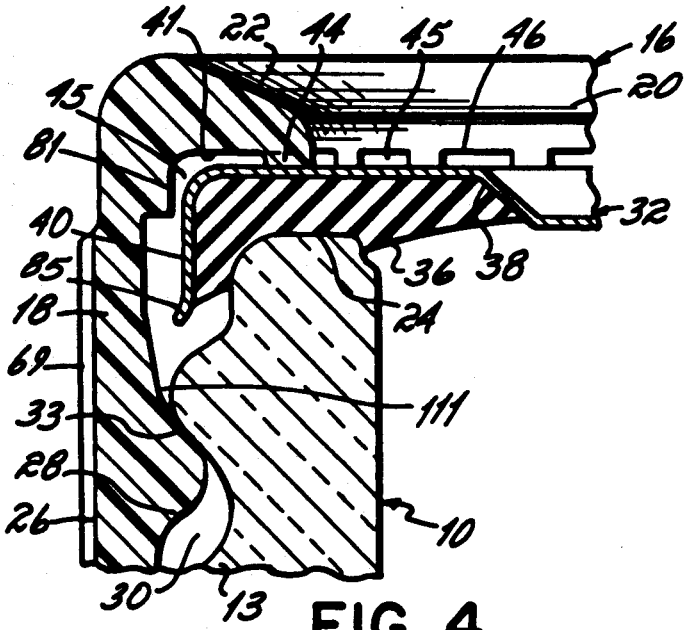
FIG. 4 is a section similar to FIG. 2 but shows the passage blocking restriction opened by heating.

In order to choke off the rush of air from below the shell, as well as from over the disk, it is preferred also to provide means for providing a seal around the peripheral lower edge 85 of the disk when the disk is lifted to break the vacuum. For this purpose shell 18 has an inwardly tapered restriction-forming shoulder 111 around its inside surface, just above thread end 33. This shoulder 111 has a diameter approximately equal to that of the outwardly flared lower edge 85 of the disk at room temperature, and is positioned so that when the closure has been tightened on the container, the shoulder is spaced below lid edge 85, as shown in FIG. 4. When the closure is unscrewed, rotation of shell 18 carries shoulder 111 upwardly relative to lid edge 85. The vacuum is broken when thread ends 33 (or a circumferential lid lifting bead) abut and lift lid edge 85 as the shell is unscrewed. (This occurs after the tamper evidencing band has been broken.) Opening the closure first breaks off the tamper indicating band, which drops down onto the shoulder of the container, before the lid is lifted. Any dirt in the pocket 79 between the tamper indicating band 122 and the retaining hoop is thereafter so far away from the gasket area that as a practical matter it is not drawn into the container as the vacuum is broken. When the shell begins to lift lid 32, shoulder 111 meets and seals the lid edge around its entire periphery and forms an effective dirt blocking restriction with it. This isolates the gasket 36 from any dirt blown downward from the top of the disk after rib 81 has been moved upwardly relative to lid 32.

Figure 3:
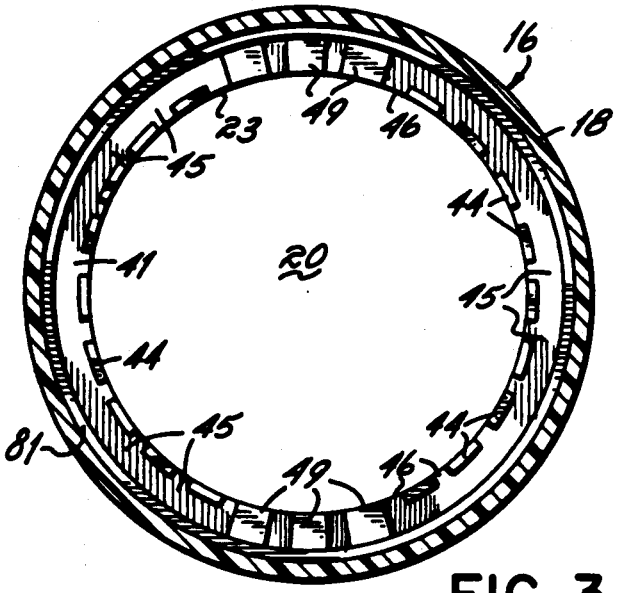
FIG. 3 is a transverse section taken on line 3—3 of FIG. 2.
Figure 5:
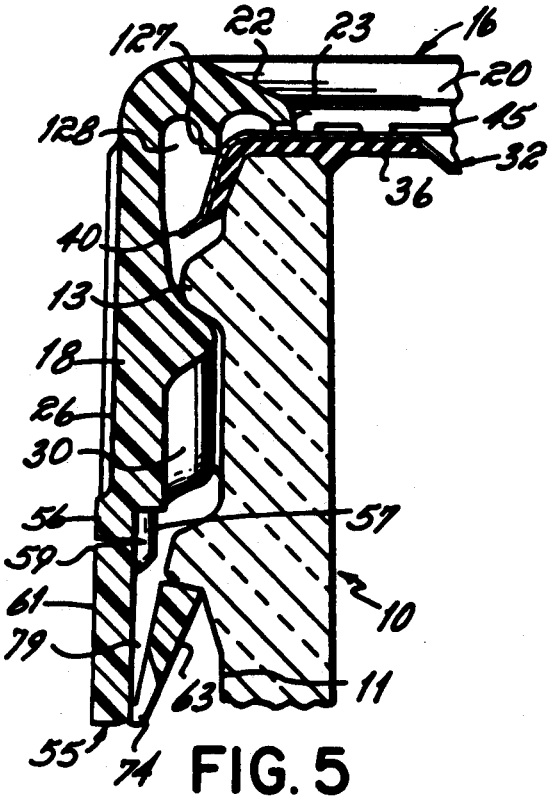
FIG. 5 is an axial section of a modified form of the invention, as embodied in a closure which can receive different insert disks for sealing different types of food products.
Figure 6:
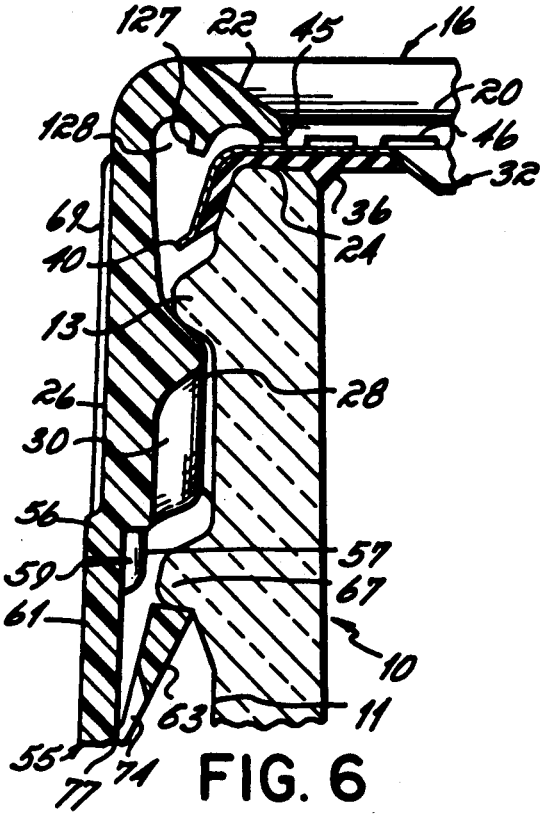
FIG. 6 is a section similar to FIG. 5, showing the restriction opened by heating.

In the embodiment shown in FIGS. 2-4, the thermally activated passage blocking means is in the form of a rib 81 in the corner where top lip 22 joins shell 18. As can be seen, providing the rib involves minimal additional material, structure, or complexity. However, where the disk edge is farther inward of that corner, passage blocking means can be provided in the form of a rib or fin which depends from the underside of lip 22, for example as shown in FIGS. 5 and 6. There a rib in the form of an annular fin 127 extends below the lip, and normally just engages against the downturned flange of the disk. A groove 128 extends outside fin 127, between it and the corner where the top lip meets the shell. As compared to a shoulder extending so far inwardly from the skirt, the depending fin uses less material and minimizes sink marks. This type of structure is useful, by way of example, in a closure which can accept different sizes of insert disks, e.g., for sealing different types of food products as disclosed in my copending application Ser. No. 535,114, previously referred to.

In addition to differential radial expansion, a second action also contributes to opening the water slot upon heating. Because the top lip 22 is cantilevered inwardly from shell 18, its inner edge 23 can flex slightly in the axial direction. When the cap is tightened on the container, the inner end 23 of the top lip tends to hinge upwardly (in the counterclockwise direction as seen in FIG. 5). The stress of the lip tends to hold fin 127 against the lid and thereby to help close the water slot. When the plastic band 18 is loosened by radial (and some vertical) expansion upon heating, the closure threads 28 move outwardly on the container threads 13, and the entire band moves and expands vertically as well as horizontally. This partially relieves the stress on top lip 22 and permits it to hinge down again toward its unstressed position. This axial hinging further opens the slots beyond the amount that is accounted for by just the difference in radial expansions of the disk and the shell. This action can occur in each of the embodiments illustrated, but it is most pronounced with the embodiment of FIG. 5 and 6 and therefore has been described with specific reference to that embodiment.

Closures with slots for water washing in accordance with this invention can also include a capability for venting excess gas pressure within the container beneath the lid. Such closures are specifically described and claimed in my copending, commonly owned, application Ser. No. 401,999, titled "Pressure Venting Closure", filed Sept. 1, 1989, to which reference may be made.

Having described the invention, what is claimed is:

1. A closure having a top, a skirt depending from said top, cooperating securing means on an inside surface of said skirt and on a container to secure the closure on said container, passages in said closure for conducting wash water from said top downwardly to a space between the securing means of the closure and container so that said securing means can be washed while said closure is secured on a container, and temperature responsive passage blocking means in said passages, said blocking means normally closing said passages to the ingress of foreign particles from the top of said closure toward said securing means, said blocking means being responsive by thermal expansion to open during hot water washing, so that wash water can flow past said blocking means to wash said securing means.

2. The closure of claim 1 wherein said skirt is an annular shell with an inwardly projecting lip and said top is an insert disk seated in said skirt beneath said lip.

3. The closure of claim 2 wherein said shell is made of a material having a greater rate of thermal expansion than said disk.

4. The closure of claim 3 wherein said shell is of plastic and said disk is of metal.

5. The closure of claim 1 wherein said passages include channels on an inside surface of said closure, said channels leading to said space between said securing means.

6. The closure of claim 5 wherein said passages include channels on an undersurface of said top lip.

7. The closure of claim 6 wherein said blocking means comprises an annular shoulder around said shell, said shoulder extending circumferentially around said disk and bearing radially against the periphery of said disk at room temperature, thereby blocking said passages, said shoulder expanding radially more than said disk, if said closure is heated in washing to a temperature above approximately 80° F., said shoulder thereby moving relatively outwardly from said disk to open said passages.

8. The closure of claim 7 wherein said shoulder is an annular edge below said lip.

9. The closure of claim 7 wherein said shoulder is presented by an annular flap projecting downwardly below said lip.

10. The closure of claim 1 wherein said passages when closed have openings no larger than about 0.005", said openings being larger than about 0.005" when said closure is heated to a temperature of at least about 180° F.

* * * * *